US009799275B2

(12) United States Patent
Kim et al.

(10) Patent No.: US 9,799,275 B2
(45) Date of Patent: Oct. 24, 2017

(54) DISPLAY DEVICE

(71) Applicant: Samsung Display Co., Ltd., Yongin, Gyeonggi-Do (KR)

(72) Inventors: Jinpil Kim, Suwon-si (KR); Sungjae Park, Wonju-si (KR); Yu-Kwan Kim, Incheon (KR); Namjae Lim, Gwacheon-si (KR)

(73) Assignee: Samsung Display Co., Ltd. (KR)

( * ) Notice: Subject to any disclaimer, the term of this patent is extended or adjusted under 35 U.S.C. 154(b) by 151 days.

(21) Appl. No.: 14/703,352

(22) Filed: May 4, 2015

(65) Prior Publication Data

US 2016/0171918 A1 Jun. 16, 2016

(30) Foreign Application Priority Data

Dec. 12, 2014 (KR) ..... 10-2014-0179591

(51) Int. Cl.

| | |
|---|---|
| ***G09G 3/20*** | (2006.01) |
| ***G09G 3/34*** | (2006.01) |
| ***G09G 3/36*** | (2006.01) |
| ***G09G 5/02*** | (2006.01) |

(52) U.S. Cl.

CPC ..... *G09G 3/3406* (2013.01); *G09G 3/3648* (2013.01); *G09G 5/02* (2013.01); *G09G 2300/0452* (2013.01); *G09G 2320/028* (2013.01); *G09G 2320/0646* (2013.01); *G09G 2340/06* (2013.01); *G09G 2360/16* (2013.01)

(58) Field of Classification Search

CPC ..... G09G 3/3406; G09G 3/3648; G09G 5/02; G09G 2360/16; G09G 2320/028; G09G 2320/0646; G09G 2340/06; G09G 2300/0452

See application file for complete search history.

(56) References Cited

U.S. PATENT DOCUMENTS

| | | | | |
|---|---|---|---|---|
| 7,893,944 | B2 | 2/2011 | Higgins et al. | |
| 2002/0003598 | A1* | 1/2002 | Steffensmeier | G02F 1/133753 349/129 |
| 2008/0055339 | A1* | 3/2008 | Chao | G09G 3/2003 345/690 |

(Continued)

FOREIGN PATENT DOCUMENTS

| | | |
|---|---|---|
| KR | 10-2011-0020712 | 3/2011 |
| KR | 10-1147100 | 5/2012 |

(Continued)

*Primary Examiner* — Andrew Sasinowski

(74) *Attorney, Agent, or Firm* — Innovation Counsel LLP

(57) ABSTRACT

Provided is a display device. The display device includes: a gamma mapping unit; a compensating signal generation unit including a limit gray scale determination unit outputting a white limit gray scale value; and a hue control compensation unit including a main color compensation unit and a white compensation unit. The white compensation unit decreases a gray scale value of the white image signal based on the white limit gray scale value to generate the white compensated signal and the main color compensation unit compensates the red, green and blue image signals based on the white limit gray scale value to generate the red, green and blue compensated signals, when gray scale value of the white image signal is larger than the white limit gray scale value.

13 Claims, 9 Drawing Sheets

(56) References Cited

U.S. PATENT DOCUMENTS

| | | | | |
|---|---|---|---|---|
| 2010/0066659 | A1* | 3/2010 | Liu | G09G 3/3413 345/102 |
| 2010/0182345 | A1* | 7/2010 | Shimoshikiryoh | H01L 29/66757 345/690 |
| 2012/0262496 | A1* | 10/2012 | Swic | G09G 3/344 345/690 |
| 2013/0215472 | A1* | 8/2013 | Rossier | H04N 1/52 358/3.06 |
| 2013/0342588 | A1 | 12/2013 | Yoshimoto | |
| 2014/0267470 | A1* | 9/2014 | Kang | G09G 3/2003 345/694 |
| 2015/0097880 | A1* | 4/2015 | Ooga | G09G 3/3406 345/694 |

FOREIGN PATENT DOCUMENTS

| | | |
|---|---|---|
| KR | 10-2012-0127239 | 11/2012 |
| KR | 10-1319321 | 10/2013 |

* cited by examiner

DISPLAY DEVICE

CROSS-REFERENCE TO RELATED APPLICATIONS

This U.S. non-provisional patent application claims priority under 35 U.S.C. §119 to Korean Patent Application No. 10-2014-0179591, filed on Dec. 12, 2014, the entire contents of which are hereby incorporated by reference.

BACKGROUND

The present disclosure herein relates to a display device that has improved visibility and color reproductivity.

A liquid crystal display (LCD) device is one of flat panel display devices and being used for displaying an image on various devices such as a TV, monitor, notebook computer and portable phone.

The LCD device controls the intensity of an electric field applied to a liquid crystal material between two substrates and controls the amount of light passing through the two substrates to display an image. The LCD display includes an LCD panel for displaying an image and a backlight unit for supplying light to the LCD panel.

A vertical align (VA) mode is one of operation modes of the LCD device and includes liquid crystals vertically aligned with a substrate and having negative dielectric anisotropy. The VA mode has a high contrast ratio and thus good display quality.

SUMMARY

The present disclosure provides a display device that has improved visibility and color reproductivity.

Embodiments of the inventive concept provide, display devices include: a gamma mapping unit mapping image information having information on three primary colors to generate image signals comprising red, green, blue, and white image signals; a compensating signal generation unit including a limit gray scale determination unit to output a white limit gray scale value; and a hue control compensation unit comprising a main color compensation unit to generate, red, green, and blue compensated signals based on the red, green, and blue image signals, respectively, and a white compensation unit to generate a white compensated signal based on the white image signal, wherein the white compensation unit decreases a gray scale value of the white image signal based on the white limit gray scale value to generate the white compensated signal and the main color compensation unit compensates the red, green and blue image signals based on the white limit gray scale value to generate the red, green and blue compensated signals, when gray scale value of the white image signal is larger than the white limit gray scale value.

In some embodiments, the hue control compensation unit may further include a white difference calculation unit to generate a white difference value having a value corresponding to a difference between the gray scale value of the white image signal and the white limit gray scale value, the main color compensation unit may calculate a compensation margin and the compensation margin may have a value corresponding to a value obtained by subtracting a maximum of gray scale values of the red, green and blue image signals from a maximum gray scale value of the image signals, and the main color compensation unit compensates the red, green, and blue image signals based on a first compensation value generated by using the white difference value, when the compensation margin is larger than the white difference value.

In other embodiments, the main color compensation unit compensates for the red, green, and blue image signals based on a second compensation value generated by using the compensation margin, when the compensation margin is smaller than the white difference value.

In still other embodiments, the display devices may further include: a backlight unit generating light; a backlight unit to generate light; a backlight control unit to drive the backlight unit; and a display panel to display an image corresponding to image data generated based on the image signal, by using the light, wherein the hue control compensation unit may further generate a backlight compensation signal based on the white difference value and the compensation margin, and the backlight control unit may use the backlight compensation signal to control the backlight unit.

In even other embodiments, the display devices may further include a scaler analyzing the image signals to calculate scaling values and scaling down the gray scale values of the image signals based on the scaling values to prevent the image signals from being out of gamut, wherein the backlight control unit may scale up luminance of light of the backlight unit according to the scaling value.

In yet other embodiments, the backlight compensation signal may have a value corresponding to a difference between the white difference value and the compensation margin, and the backlight control unit may increase luminance of light generated from the backlight unit in response to the backlight compensation signal.

In further embodiments, the display devices may further include: a backlight unit to generate light; and a display panel to display an image corresponding to image data generated based on the image signal, by using the light, wherein the white limit gray scale value is predetermined based on a color coordinate characteristic of the display panel according to a viewing angle.

In still further embodiments, change in hue according to the viewing angle of a white image displayed from the display panel is a minimum at the white limit gray scale value.

In even further embodiments, a sum of a difference between first and second x coordinates and a difference between first and second y coordinates has a minimum value at the white limit gray scale value, the first x coordinate and the first y coordinate are x and y coordinates on a CIE coordinate system of a white image displayed on the display panel when viewed from a front, and the second x coordinate and the second y coordinate are x and y coordinates on the CIE coordinate system of the white image displayed on the display panel viewed from a side.

In yet further embodiments, the display panel may include a first substrate, a second substrate, and a liquid crystal layer interposed between the first and second substrates, and the liquid crystal layer may include a vertically aligned liquid crystal molecule when no electric field is applied to liquid crystal molecules.

In much further embodiments, the display panel may include red, green, blue, and white sub pixels.

In still much further embodiments, the display devices may further include a sub pixel rendering unit to receive the red, green, blue and white compensated signals and converting the red green, blue and white compensated signals into red, green, blue, and white image data, respectively, through re-sample filtering, wherein the red, green, blue, and white image data may be provided to the red, green, blue, and white sup pixels.

In even much further embodiments, the display devices may further include an operation initiate determination unit calculating a hue of the image information and generating an operation initiate signal having information on whether the calculated hue of the image information belongs to a preset target hue, wherein the compensating signal generation unit may output, in response to the operation signal, the white limit gray scale value when the hue of the image information belongs to the target hue, and the hue control compensation unit may compensate for, in response to the operation initiate signal, the red, green, and blue image signals to generate the red, green, blue, and white compensated signals, respectively, when the hue of the image information belongs to the target hue.

In yet much further embodiments, the compensated white signal may have the white limit gray scale value when the gray scale value of the white image signal is larger than the white limit gray scale value.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION OF THE EMBODIMENTS

Figure 1:
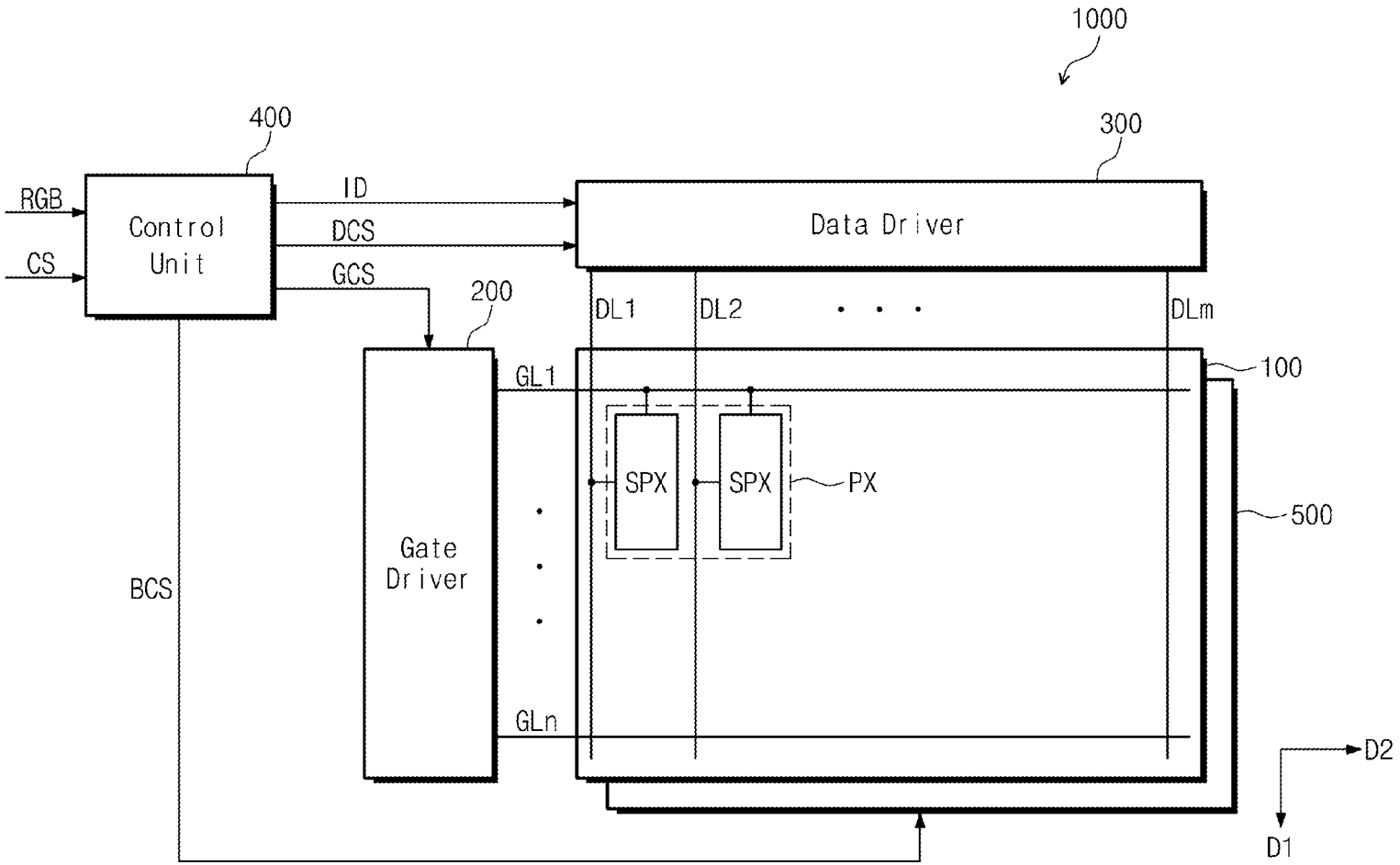
FIG. 1 is a schematic block diagram of a display device according to an embodiment of the inventive concept.

Since the inventive concept may implement various changes and have many forms, particular embodiments are illustrated in the drawings and described in detail in the detailed description. However, the inventive concept is not intended to be limited to particular, disclosed embodiments and it should be understood that the inventive concept covers all modifications, equivalents, and replacements that fall within the spirit and technical scope of the inventive concept.

In describing each drawing, similar reference numerals are used for similar components. In the accompanying drawings, the dimensions of structures are shown to be expanded than their actual dimensions for the clarity of the inventive concept. Although the terms 'first' and 'second' may be used to describe various components, these components should not be limited to these terms. The terms are used only in order to distinguish a component from another component. For example, without departing from the scope of rights of the inventive concept, a first component may be called a second component and similarly, the second component may also be called the first component. The terms in singular form include the plural form unless otherwise specified.

In the present application, it should be understood that the term "includes" or "has" indicates the presence of characteristics, numbers, steps, operations, components, parts or combinations thereof represented in the present disclosure and does not exclude the presence or addition of one or more other characteristics, numbers, steps, operations, components, parts or combinations thereof. Also, when a component such as a layer, film, area, or plate is referred to as being "on" another component, it can be directly on the other component or intervening components may also be present in between. On the contrary, when a component such as a layer, film, area, or plate is referred to as being "under" another component, it can be "directly under" the other component or intervening components may also be present in between.

Various embodiments of the inventive concept are described below in more detail with reference to the accompanying drawings.

FIG. 1 is a schematic block diagram of a display device according to an embodiment of the inventive concept.

Referring to FIG. 1, a display device 1000 according to an embodiment of the inventive concept includes a display panel 100 displaying an image, a gate driver 200 and data driver 300 driving the display panel 100, and a control unit 400 controlling the driving of the gate driver 200 and the data driver 300.

The control unit 400 receives image information RGB and a plurality of control signals CS from an outside of the display device 1000. In order to be suitable for the interface specification of the data driver 300, the control unit 400 converts the data format of the image information RGB to generate image data ID and provides the image data ID to the data driver 300.

Also, the control unit 400 generates a data controls signal (DCS; e.g., output initiate signal and horizontal initiate signal) and a gate control signal (GCS; e.g., vertical initiate signal, vertical clock signal and vertical clock-bar signal) based on the plurality of control signals CS. The data control signal DCS is provided to the data driver 300 and the gate control signal GCS is provided to the gate driver 200.

The gate driver 200 sequentially outputs the gate signals in response to the gate control signal GCS provided from the control unit 400.

In response to the data control signal DCS provided from the control unit 400, the data driver 300 converts the image data ID into data voltages to output the data voltages. The data voltages output are applied to the display panel 100.

The display panel 100 includes a plurality of gate lines GL1 to GLn, a plurality of data lines DL1 to DLm and a plurality of pixels PX. The pixel PX may include a plurality of sub pixels SPX. The pixel PX is a device displaying a unit image configuring an image and the resolution of the display panel 100 may be determined according to the number of the pixels PX in the display panel 100. For the convenience of description, only any one of the pixels PX is shown and the others are omitted.

The plurality of gate lines GL1 to GLn extend in a second direction D2 and arranged in parallel to one another in a first direction D1 perpendicular to the second direction D2. The plurality of gate lines GL1 to GLn is connected to the gate driver 200 to receive the gate signals from the gate driver 200.

The plurality of data lines DL1 to DLm extend in the first direction D1 and arranged in parallel to one another in the second direction D2. The plurality of data lines DL1 to DLm is connected to the data driver 300 to receive the data voltages from the data driver 300.

The sub pixel SPX may be connected to a corresponding one of the plurality of gate lines GL1 to GLn and to a corresponding one of the plurality of data lines DL1 to DLm to be driven.

The display device 1000 may further include a backlight unit 500. The backlight unit 500 is disposed on the rear side of the display panel 100 and faces the display panel 100. The backlight unit 500 receives a backlight control signal BCS generated at the control unit 400. The backlight unit 500 generates light in response to the backlight control signal BCS and supplies the light to the display panel 100.

Figure 2:
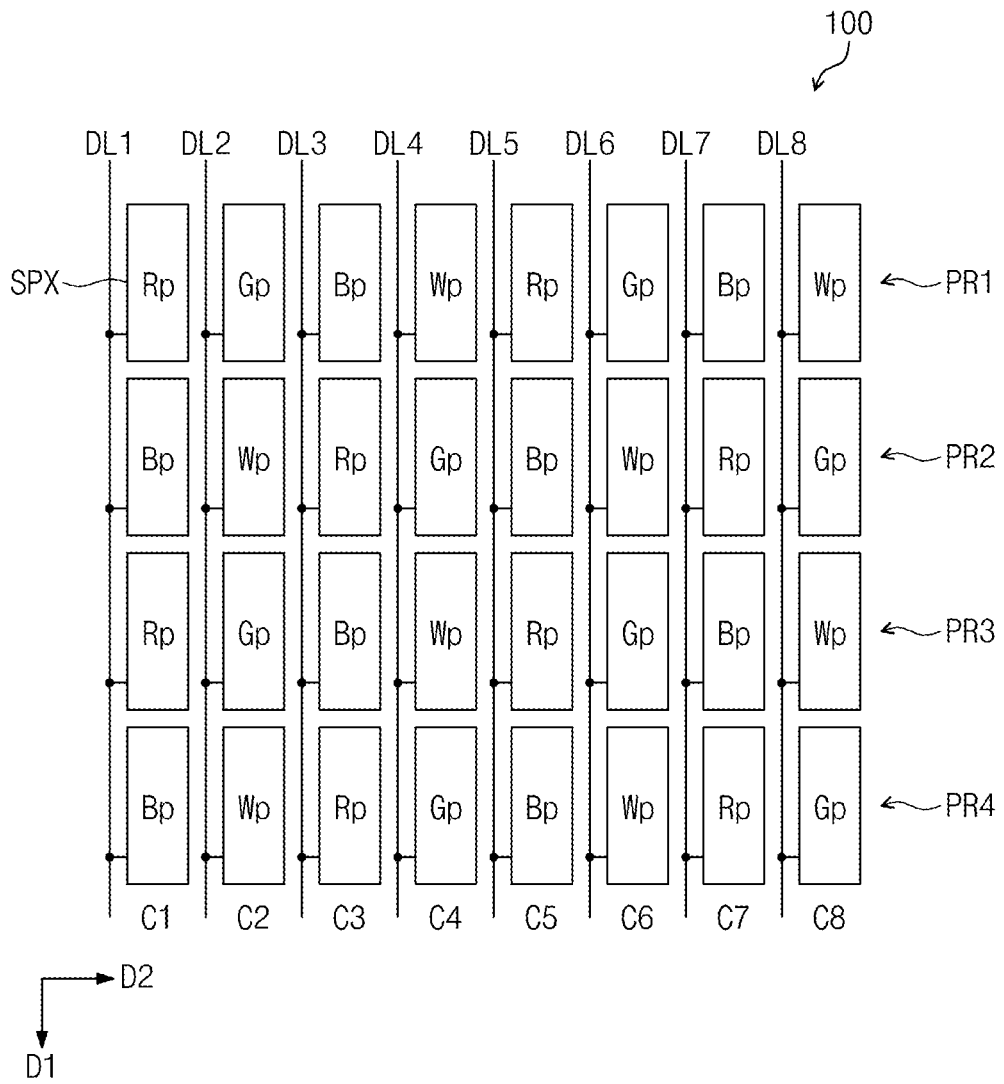
FIG. 2 is an enlarged plane view of a portion of a display panel in FIG. 1.

FIG. 2 is an enlarged plan view of a portion of a display panel in FIG. 1.

FIG. 2 illustrates sub pixels SPX connected to first to eighth data lines DL1 to DL8. The sub pixels SPX include a plurality of red sub pixels Rp representing red, a plurality of green sub pixels Gp representing green, a plurality of blue sub pixels Bp representing blue, and a plurality of white sub pixels Wp representing white. However, the inventive concept is not limited thereto and the sub pixel SPX may further include yellow pixels, cyan pixels, and magenta pixels that represent yellow, cyan, and magenta, respectively.

The sub pixels SPX are arranged in the first direction D1 and in the second direction D2 to have a matrix shape. Among the sub pixels SPX, a set of pixels arranged sequentially in the second direction D2 may be defined as a row of pixels, and a set of pixels sequentially in the first direction D1 may be defined as a column of pixels. The display panel 100 may include a plurality of rows of pixels and a plurality of columns of pixels. FIG. 2 shows first to eighth columns of pixels C1 to C8 and among the plurality of columns of pixels and first to fourth rows of pixels PR1 to PR4 among the plurality of rows of pixels.

In odd rows of pixels PR1 and PR3 among the rows of pixels, the red sub pixel Rp, the green sub pixel Gp, the blue sub pixel Bp, and the white sub pixel Wp may be repetitively arranged in the order of the red sub pixel Rp, the green sub pixel Gp, the blue sub pixel Bp, and the white sub pixel Wp, starting from the first column of pixels C1. In even rows of pixels PR2 and PR4 among the rows of pixels, the red sub pixel Rp, the green sub pixel Gp, the blue sub pixel Bp, and the white sub pixel Wp may be repetitively arranged in the order of the blue sub pixel Bp, and the white sub pixel Wp, the red sub pixel Rp, and the green sub pixel Gp, starting from the first column of pixels C1.

Figure 3:
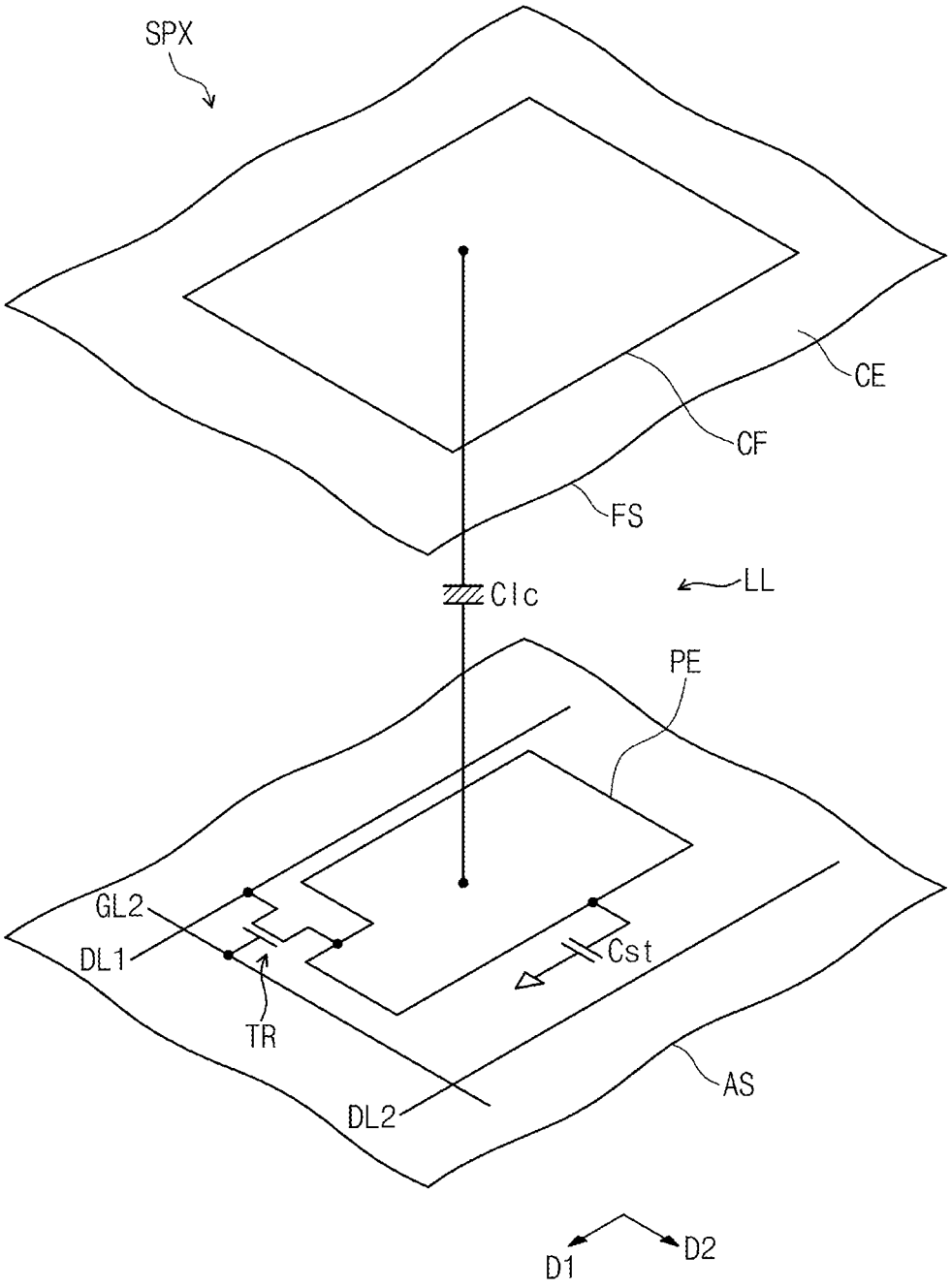
FIG. 3 is a schematic diagram of a sub pixel in FIG. 2.

FIG. 3 is a schematic diagram of a sub pixel in FIG. 2.

Referring to FIG. 3, the display panel 100 includes an array substrate AS, a counter substrate FS and a liquid crystal layer LL interposed between the array substrate AS and the counter substrate FS.

The sub pixel SPX includes a transistor TR connected to the second gate line GL2 and to the first data line DL1, a liquid crystal capacitor Clc connected to the transistor TR, and a storage capacitor Cst connected in parallel to the liquid crystal capacitor Clc. The storage capacitor Cst may be omitted.

The transistor TR may be disposed on the array substrate AS. The transistor TR includes a gate electrode connected to the second gate line GL2, a source electrode connected to the first data line DL1, and a drain electrode connected to the liquid crystal capacitor Clc and to the storage capacitor Cst.

The liquid crystal capacitor Clc includes a pixel electrode PE disposed on the array substrate AS, a common electrode CE disposed on the counter substrate FS, and the liquid crystal layer LL disposed between the pixel electrode PE and the common electrode CE. In this case, the liquid crystal layer LL functions as a dielectric. The liquid crystal layer LL includes liquid crystal molecules. The liquid crystal molecules may have negative dielectric anisotropy. Also, the liquid crystal molecules may be vertically aligned with the array substrate AS and the counter substrate FS when no electric field is applied to the liquid crystal molecules.

The pixel electrode PE is connected to the drain electrode of the transistor TR. The common electrode CE may be entirely disposed on the counter substrate FS. However, the inventive concept is not limited thereto and the common electrode CE may be disposed on the array substrate AS. In this case, at least one of the pixel electrode PE and the common electrode CE may include a slit.

The storage capacitor Cst may include the pixel electrode PE, a storage electrode (not shown) branched from the storage line (not shown), and a dielectric layer disposed between the pixel electrode PE and the storage electrode. The storage line may be disposed on the array substrate AS and formed together with the second gate line GL2 on the same layer as the second gate line GL2. The storage electrode may partially overlap the pixel electrode PE.

The sub pixel SPX may further include the color filter CF representing one of primary colors. As an exemplary embodiment, the color filter CF may be disposed on the counter substrate FS. However, the inventive concept is not limited thereto and the color filter CF may be disposed on the array substrate AS.

The transistor TR is turned on in response to a gate signal provided through the second gate line GL2. A data voltage received through the first data line DL1 is provided to the pixel electrode PE of the liquid crystal capacitor Clc through a turned-on transistor TR. A common voltage is applied to the common electrode CE.

An electric field is formed between the pixel electrode PE and the common electrode CE by a difference in voltage level between the data voltage and the common voltage. The liquid crystal molecules of the liquid crystal layer LL is driven by the field formed between the pixel electrode PE and the common electrode CE. Light transmittance may be controlled by the liquid crystal molecules driven by the electric field formed, thus an image may be displayed.

A storage voltage having a certain voltage level may be applied to the storage line. However, the inventive concept is not limited thereto and the storage line may receive the common voltage. The storage capacitor Cst plays a role in maintaining a charged voltage in the liquid crystal capacitor Clc.

Figure 4:
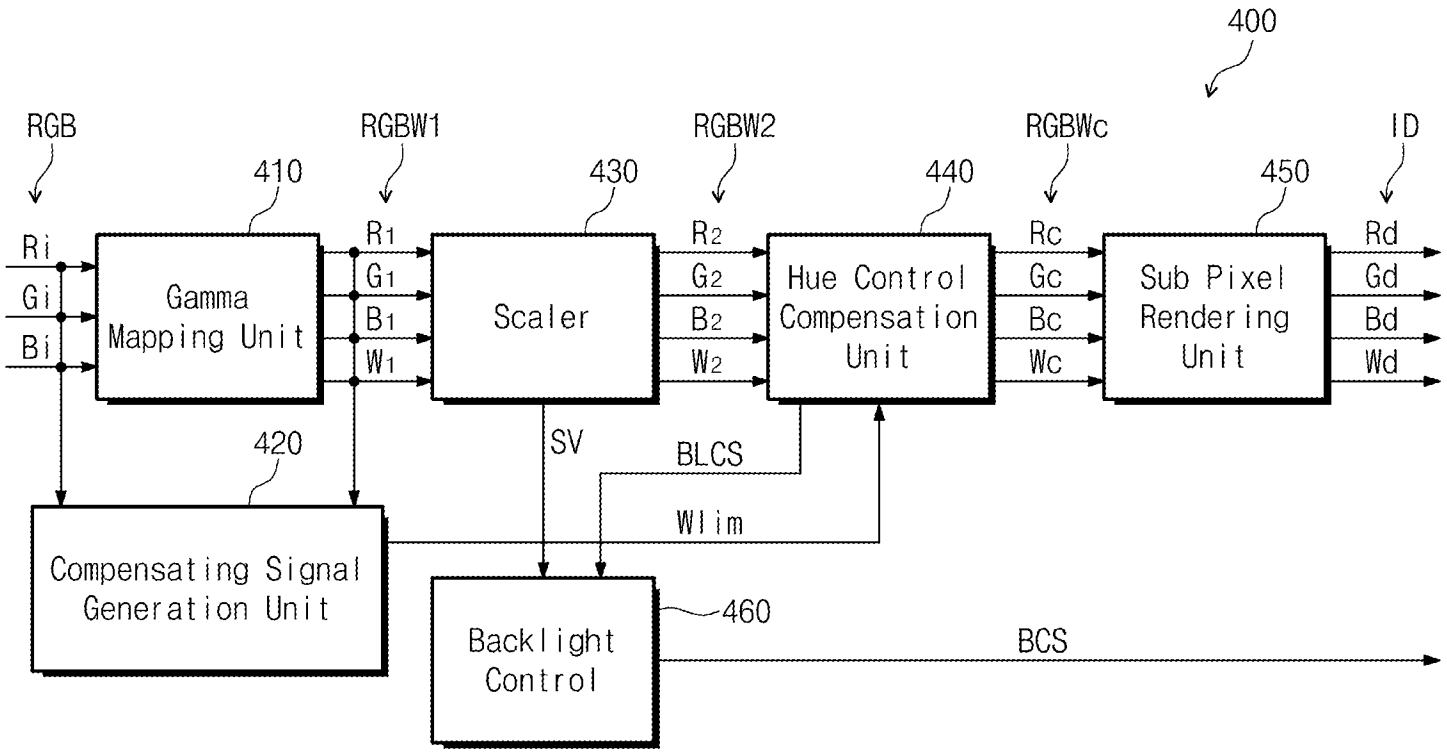
FIG. 4 is a block diagram of a control unit 400 in FIG. 1.

FIG. 4 is a block diagram of a control unit in FIG. 1.

Referring to FIG. 4, a control unit 400 includes a gamma mapping unit 410, a compensating signal generation unit 420, a scaler 430, a hue control compensation unit 440, a sub pixel rendering unit 450, and a backlight control unit 460.

The gamma mapping unit 410 maps the image information RGB to a first image signal RGBW1. The gamma mapping unit 410 may map the RGB color gamut of the image information to the RGBW color gamut through a gamut mapping algorithm (GMA) to generate the first image signal RGBW1. The first image signal RGBW1 may be provided to the compensating signal generation unit 420 and the scaler 430.

The image information RGB may include information on three primary colors. For example, the image information RGB may include red information Ri, green information Gi, and blue information Gi that have information on red, green and blue, respectively.

The first image signal RGBW1 may include information on four primary colors. For example, the first image signal RGBW1 includes a first red signal R1, a first green signal G1, a first blue signal B1, and a first white signal W1 that have information on red, green, blue, and white, respectively.

Also, although not particularly shown in FIG. 4, the gamma mapping unit 410 may further generate the luminance data of the image information RGB in addition to the first image signal RGBW1. The luminance data may be provided to the sub pixel rendering unit 450 and utilized for a sharp filtering operation.

The scaler 430 prevents the first image signal RGBW1 from being out of gamut by the first white signal W1, scales the gray scale value of the first image signal RGBW1 in order to prevent the gray scale value of the first image signal RGBW1 from having an illegal data value, and controls the luminance of the backlight unit 500 (in FIG. 1).

More particularly, the scaler 430 receives the first image signal RGBW1, analyzes the importance of saturated colors in an image of the current frame by using a histogram, and calculates a scaling value SV based thereon. Then, the scaler 430 compensates for the first image signal RGBW1 based on the scaling value SV, and generates a second image signal RGBW2. Also, the scaler 430 outputs the scaling value SV to the backlight control unit 460.

For example, when the importance of a saturated color such as yellow in the current frame is high, the scaler 430 may scale down the gray scale values of the first image signal RGBW1 according to the scaling value SV to generate the second image signal RGBW2, and scale up the luminance of light of the backlight unit 500 according to the scaling value SV.

The second image signal RGBW2 may include a second red signal R2, a second green signal G2, a second blue signal B2, and a second white signal W2 that have information on red, green, blue, and white, respectively. The second red signal R2, second green signal G2, second blue signal B2, and second white signal W2 may be generated by multiplying the first red signal R1, first green signal G, first blue signal B1, and first white signal W1 by the scaling value SV, respectively.

For example, when the scaling value SV is 0.5, the scaler 430 multiplies the gray scale values of the first image signal RGBW1 by 0.5 to generate the gray scale values of the second image signal RGBW2, and the backlight control unit 460 drives the backlight unit 500 so that the luminance of light generated at the backlight unit 500 (in FIG. 1) becomes 2 times (Gray scale values of the second image signal RGBW=1/SV=1/0.5=2).

The compensating signal generation unit 420 receives the image information RGB and first image signal RGBW1, and generates a white limit gray scale value Wlim and a white difference value Wdiff according to the image information RGB and the first image signal RGBW1.

The hue control compensation unit 440 receives the second image signal RGBW2 from the scaler 430 and receives the white limit gray scale value Wlim from the compensating signal generation unit 420. The hue control compensation unit 440 compensates for the second image signal RGBW2 based on the white limit gray scale value Wlim to generate a compensated signal RGBWc. Also, the hue control compensation unit 440 may generate and output a backlight compensation signal BLCS to the backlight control unit 460.

The compensating signal generation unit 420 and the hue control compensation unit 440 are described in more detail with reference to FIGS. 5 to 7.

The sub pixel rendering unit 450 generates the image data ID having a format matching the layout of the sub pixel SPX of the display panel 100. The sub pixel rendering unit 450 performs a rendering operation on the compensated signal RGBWc and generates the image data ID. The rendering operation of the sub pixel rendering unit 450 may include a re-sample filtering operation and a sharp filtering operation.

In the re-sample filtering operation, a target pixel data is generated using compensated signal RGBWc of the target pixel and the pixels adjacent to the target pixel.

The re-sample filtering operation may be performed by applying e.g., a diamond filter to the compensated signal RGBWc. More particularly, the red, green, blue and white data Rd, Gd, Bd and Wd of the image data ID may be generated by applying the diamond filter to compensated red, compensated green, compensated blue, and compensated white signals Rc, Gc, Bc, and Wc, respectively.

Also, the sub pixel rendering unit 450 may compensate for the image data ID through the sharp filtering operation after the re-sample filtering operation. More particularly, the sharp filtering operation may determine a line, edge, spot and diagonal line from the first image signal RGBW1 to compensate for and output image data ID so that the line, edge, dot and diagonal line may be appropriately displayed.

The red, green, blue, and white data Rd, Gd, Bd and Wd are converted into data voltages by the data driver 300 (in FIG. 1) to be provided to the red, green, blue, and white sub pixels Rp, Gp, Bp and Wp (in FIG. 2).

The backlight control unit 460 receives the scaling value SV and the backlight compensation signal BLCS, and uses the backlight compensation signal BLCS and the scaling value SV to generate the backlight control signal BCS. The backlight control unit 460 may control the driving of the backlight unit 500 (in FIG. 1) through the backlight control signal BCS and control the luminance of light generated at the backlight unit 500.

Although not shown in FIG. 4, an input gamma conversion unit may be further included at the front end of the gamma mapping unit 410. The input gamma conversion unit adjusts and outputs the gamma characteristic of the image information RGB in order to facilitate data processing at the gamma mapping unit 410 and sub pixel rendering unit 450 that are followed. More particularly, the input gamma conversion unit performs linearization on the image information RGB to output linearized image information so that the non-linear gamma characteristic of the image information RGB is proportional to luminance.

Also, an output gamma conversion unit may be further included at the rear end of the sub pixel rendering unit 450, correspondingly. The output gamma conversion unit performs inverse gamma compensation on the image data ID to output non-linear image data ID.

Figure 5:
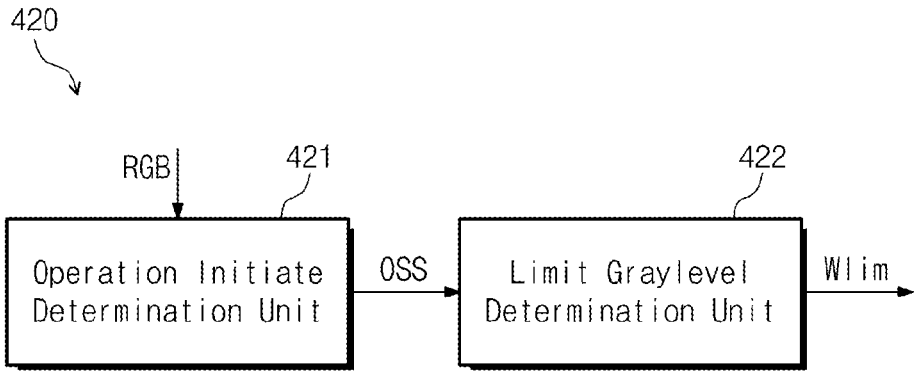
FIG. 5 is a block diagram of a compensating signal generation unit in FIG. 4.
Figure 6:
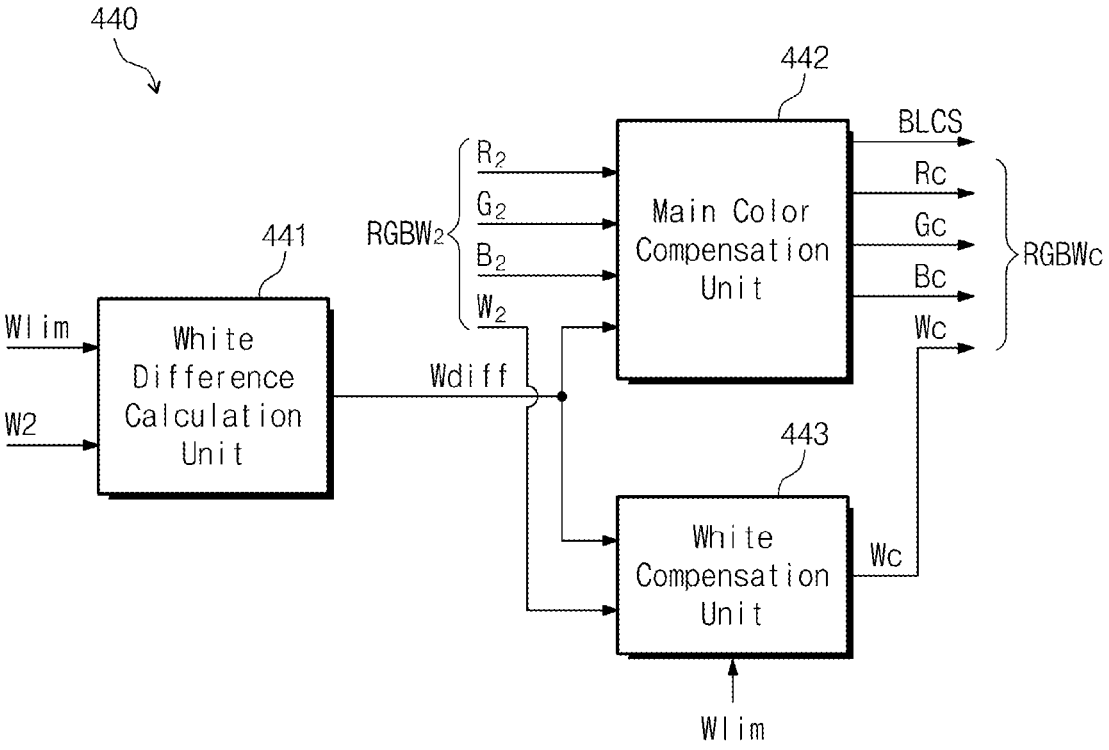
FIG. 6 is a block diagram of a hue control compensation unit 440 in FIG. 4.
Figure 7:
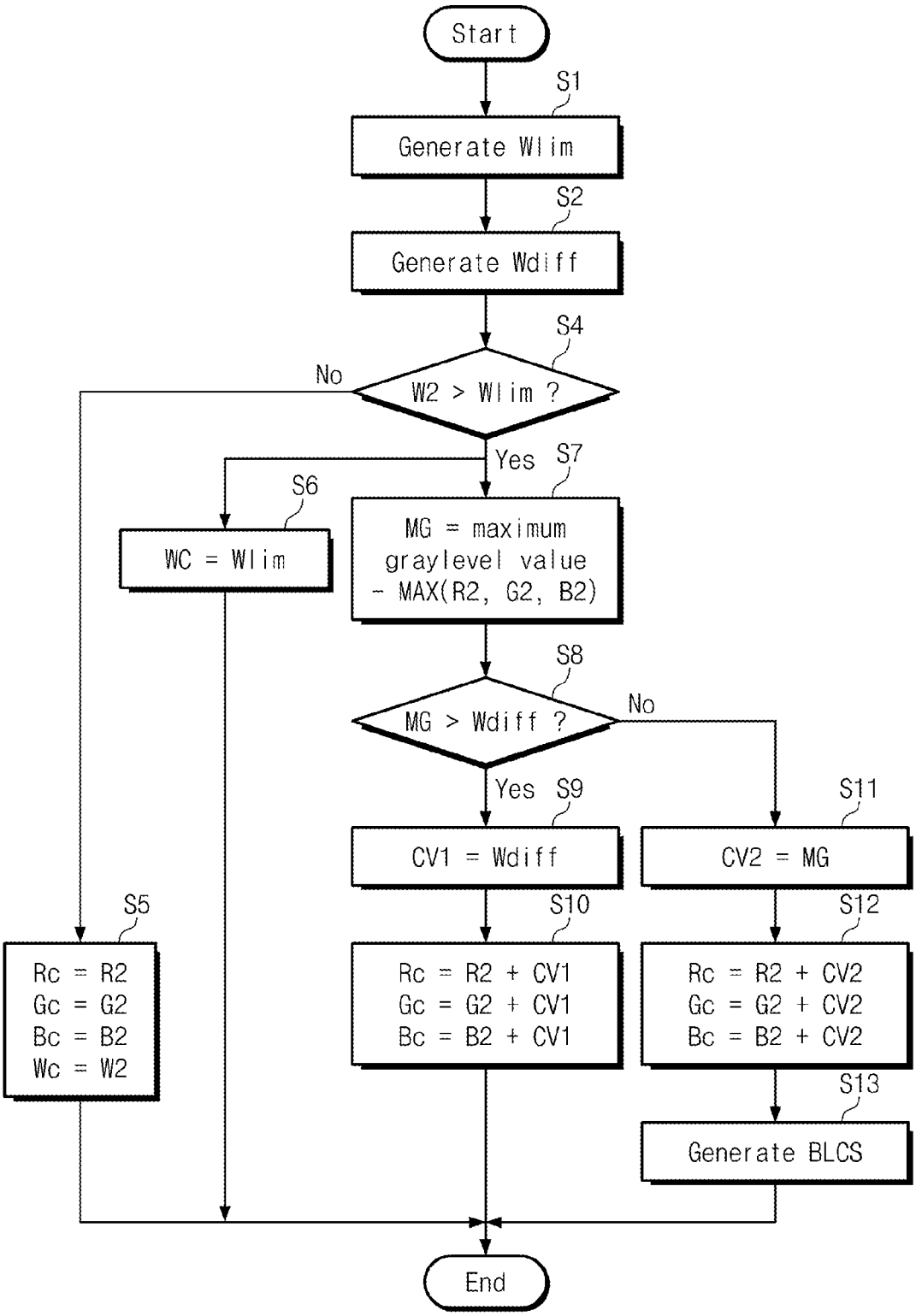
FIG. 7 is a flowchart of an operation of a control unit according to an embodiment of the inventive concept.

FIG. 5 is a block diagram of a compensating signal generation unit in FIG. 4, FIG. 6 is a block diagram of the hue control compensation unit 440 in FIG. 4 and FIG. 7 is a flowchart of an operation of a control unit according to an embodiment of the inventive concept.

In the following, the operation of the control unit according to an embodiment of the inventive concept is described with reference to the block diagrams in FIGS. 5 and 6 and the flowchart in FIG. 7.

Referring to FIG. 5, the compensating signal generation unit 420 includes an operation initiate determination unit 421 and a limit gray scale determination unit 422.

The operation initiate determination unit 421 receives the image information RGB and generates an operation initiate signal OSS based on the image information (RGB).

The operation initiate determination unit 421 determines the hue of the image information RGB form the image information RGB. For example, the operation initiate determination unit 421 may calculate the hue of the image information RGB form the image information RGB and determine whether a calculated hue belongs to a preset target hue.

The operation initiate signal OSS may include information that an operation initiates when the hue of the image information RGB belongs to the target hue, and information that the operation does not initiate when the hue of the image information RGB does not belong to the target hue.

The target hue may correspond to e.g., a saturated color. The saturated color may be a color that has little white component, such as a primary color like red, green or blue, or a secondary primary color like yellow, cyan, and magenta. As an example, the target hue may correspond to a skin color close to yellow. The skin color is one of memorial colors that a user memorizes, and a color that may be easily recognized by a user whether the impression of the color on a displayed image is natural when compared to the original impression of the color.

The operation initiate determination unit 421 may provide the operation initiate signal OSS so that the limit gray scale determination unit 422 and the hue control compensation unit 440 operate, only when the hue of the image information RGB is a hue that may be easily recognized by a user. As such, since the limit gray scale determination unit 422 and the hue control compensation unit 440 perform operations only when a specific color is included in the image information RGB, computational burden in processing data may decrease and degradation in picture quality by unnecessary compensation may be prevented.

The limit gray scale determination unit 422 generates and outputs the white limit gray scale value Wlim in step S1. The white limit gray scale value Wlim plays roles in decreasing the importance of the second white signal W2 and increasing the importance of the second red, second green, and second blue signals R2, G2, and B2 in order to compensate for the luminance decreased according to the second white signal W2 decreased.

Also, the limit gray scale determination unit 422 may operate to output the white limit gray scale value Wlim, only when the hue of the image information RGB belongs to the target hue in response to the operation initiate signal OSS, as described above.

The white limit gray scale value Wlim may be preset based on e.g., color coordinate characteristic of the display panel 100 (in FIG. 1). The color coordinate characteristic of the display panel 100 may include a change in color coordinate according to a viewing angle. For example, viewing angle vs. color coordinate characteristic of the display panel 100 may be represented by a graph in FIG. 8.

Figure 8:
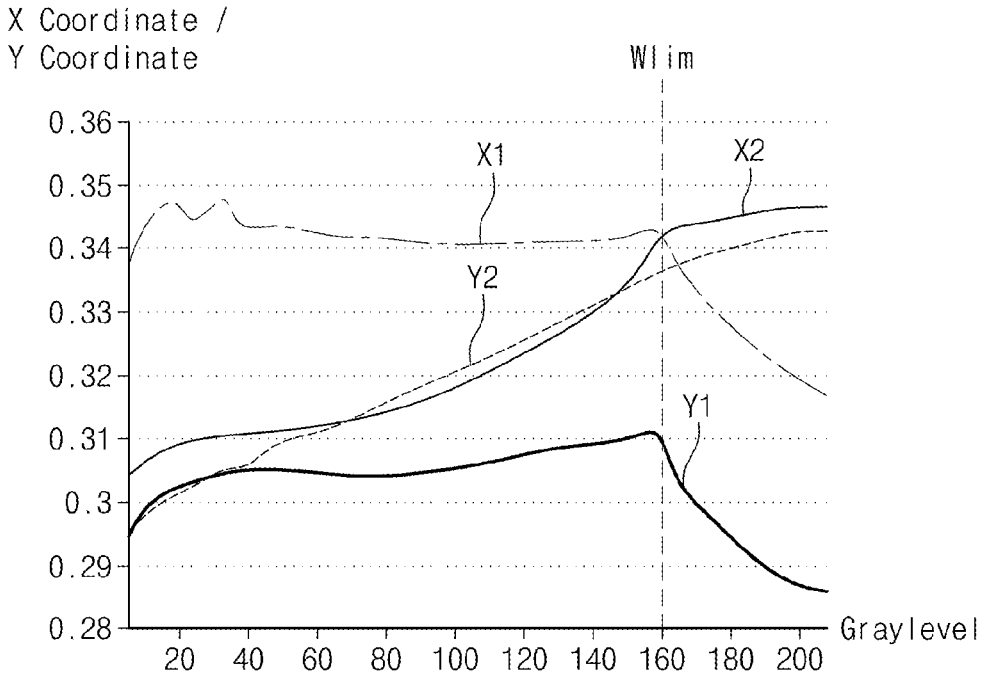
FIG. 8 is a graph of viewing angle vs. color coordinate characteristic of a display panel according to an embodiment of the inventive concept.

FIG. 8 is a graph of gray scale vs. color coordinate characteristic of a display panel according to an embodiment of the inventive concept. More particularly, FIG. 8 is a graph showing, a first x coordinate x1 and a first y coordinate y1 on a CIE coordinate system when the display panel 100 displaying a white image is viewed from the front of the display panel ("front view") and a second x coordinate x2 and a second y coordinate y2 on the CIE coordinate system when the display panel is viewed from the side of the display panel ("side view"), according to the gray scale value of the white image.

In this example, being viewed from the front of the display panel means when an angle between a virtual line passing through a user and the display panel, and the thickness direction of the display panel is close to zero, and being viewed from the side of the display panel means when the angle is close to about 90 degrees. Also, when the display panel 100 displays the white image, the red, green, blue, and white sub pixels Rp, Gp, Bp and Wp may display red, green, blue, and white having the same gray scale, respectively.

In general, a user cannot easily recognize a change in hue at high gray scale but easily recognizes a change in hue at low gray scale. Referring to FIG. 8, in front view, the first x coordinate and first y coordinate (x1, y1) are almost constant at low gray scale, but in side view, the second x coordinate and second y coordinate (x2, y2) continue to change in color coordinate as the gray scale value increases. This is because the color coordinate of an image displayed on the white sub pixel Wp (in FIG. 2) of the display panel 100 is significantly affected by the movement of the vertically aligned liquid crystal molecules which varies depending on the gray scale.

Also, a sum of the difference between the first and second x coordinates x1 and x2 and the difference between the first and second y coordinates y1 and y2 is large especially at low gray scale. This is because the color coordinate displayed on the white sub pixel Wp is significantly affected by the viewing angle.

The white limit gray scale value Wlim may be preset based on such a color coordinate characteristic according to the viewing angle of the display panel 200. In an embodiment of the inventive concept, change in hue according to the viewing angle of the white image at the white limit gray scale value Wlim may be smaller than change in hue according to the viewing angle of the white image at all other gray scale values except for the white limit gray scale value Wlim. In other words, a variation in hue according to the viewing angle of the display panel 100 is smallest at the white limit gray scale value Wlim.

More particularly, a sum of the difference between the first and second x coordinates x1 and x2 and the difference between the first and second y coordinates y1 and y2 of the white image at the white limit gray scale value Wlim may be smaller than a sum of the difference between the first and second x coordinates x1 and x2 and the difference between the first and second y coordinates y1 and y2 of the white image at all other gray scale values except form the white limit gray scale value Wlim. In other words, the sum of the difference between the first and second x coordinates x1 and x2 and the difference between the first and second y coordinates y1 and y2 of the display panel 100 has a minimum value at the white limit gray scale value Wlim.

For example, the white limit gray scale value Wlim may be set to about gray scale 160, as shown in FIG. 8. In this case, the sum of the difference between the first and second x coordinates x1 and x2 and the difference between the first and second y coordinates y1 and y2 at about gray scale 160 has a minimum value.

As shown in FIG. 6, the hue control compensation unit 440 includes a white difference calculation unit 441, a main color compensation unit 442, and a white compensation unit 443.

The hue control compensation unit 440 may operate to compensate for the red image, green image, and blue image signals to generate the red, green, blue, and white compensated signals, respectively, only when the hue of the image information RGB belongs to the target hue in response to the operation initiate signal OSS, as described above.

The white difference calculation unit 441 receives the white limit gray scale value Wlim and the second white signal W2 and generates a white difference value Wdiff based on the white limit gray scale value Wlim and the second white signal W2 in step S2. More particularly, the white difference calculation unit 441 calculates the difference between the white limit gray scale value Wlim and the gray scale value of the second white signal W2, and generates the white difference value Wdiff having a value corresponding to the difference calculated. The white difference calculation unit 441 outputs the white difference value Wdiff to the main color compensation unit 442 and the white compensation unit 443.

The main color compensation unit 442 receives the second red, second green, second blue signals R2, G2, and B2, and the white difference value Wdiff, and generates the compensated red, compensated green, and compensated blue signals Rc, Gc, and Bc of the compensated signals RGBWc. Also, the white compensation unit 443 receives the second white signal W2 and the white difference value Wdiff, and generates the compensated white signal Wc of the compensated signal RGBWc.

The main color compensation unit 442 and the white compensation unit 443 determines whether the second white signal W2 has a value smaller than the white limit gray scale value Wlim in step S4. For example, the main color compensation unit 442 and the white compensation unit 443 determines whether the white difference value Wdiff is a negative number or positive number, and may thus determine whether the second white signal W2 has a value smaller than the white limit gray scale value Wlim.

When the second white signal W2 has a value smaller than the white limit gray scale value Wlim, the main color compensation unit 442 outputs the compensated red, compensated green, and compensated blue signals Rc, Gc and Bc having values corresponding respectively to the second red, second green, and second blue signals R2, G2, and B2, and the white compensation unit 443 generates the compensated white signal Wc having a value corresponding to the second white signal W2 in step S5.

When the second white signal W2 has a value larger than the white limit gray scale value Wlim, the white compensation unit 443 generates the compensated white signal Wc having the white limit gray scale value Wlim in step S6. However, the inventive concept is not limited thereto and the white compensation unit 443 may decrease the gray scale value of the second white signal W2 based on the limit gray scale value and generate the compensated white signal We to have a decreased gray scale value of the white image W2.

When the second white signal W2 has a value larger than the white limit gray scale value Wlim, the main color compensation unit 442 calculates a compensation margin MG in step S7. The compensation margin MG may have a value corresponding to a value obtained by subtracting the maximum of the gray scale values of the second red, second green, and second blue signals R2, G2 and B2 from the maximum gray scale value of the second image signal RGBW2. (See FIG. 9)

As an example, the maximum gray scale value may be gray scale 255. For example, when the gray scale values of the second red, second green and second blue signals R2, G2, and B2 are 220, 200 and 180, respectively, the maximum of the gray scale values of the second red, second green and second blue signals R2, G2, and B2 is 200 and the compensation margin MG may be 255−220=35 as disclosed in FIG. 9).

The main color compensation unit 442 determines whether the compensation margin MG is larger than the white difference value Wdiff in step S8.

When the compensation margin MG is larger than the white difference value Wdiff, the main color compensation unit 442 generates a first compensation value CV1 generated based on the white difference value Wdiff in step S9. As an example, the first compensation value CV1 may have a value that is substantially the same as the white difference value Wdiff.

Then, the main color compensation unit 442 compensates for the second red, second green, second blue signals R2, G2, and B2 based on the first compensation value CV1 to generate the compensated red, compensated green, and compensated blue signals Rc, Gc, and Bc in step S10.

As an example, the compensated red, compensated green, and compensated blue signals Rc, Gc, and Bc may be generated by the adding of the first compensation value CV1 to the compensated red, compensated green, and compensated blue signals Rc, Gc, and Bc, respectively.

In a case where the compensation margin MG is smaller than the white difference value Wdiff, when the second red, second green, and second blue signals R2, G2, and B2 are compensated for based on the first compensation value CV1 to generate the compensated red, compensated green, and compensated blue signals Rc, Gc, and Bc, the compensated red, compensated green, and compensated blue signals Rc, Gc, and Bc may have gray scale values exceeding the maximum gray scale value (e.g., 255).

Thus, when the compensation margin MG is smaller than the white difference value Wdiff, the main color compensation unit 442 may generate a second compensation value CV2 generated based on the compensation margin MG in step S11, and may generate the compensated red, compensated green, and compensated blue signals Rc, Gc, and Bc by compensating for the second red, second green, and second blue signals R2, G2, and B2 based on the second compensation value CV2 in step S12.

As an example, the second compensation value CV2 may have a value that is substantially the same as the compensation margin MG.

Also, as an example, the compensated red, compensated green, and compensated blue signals Rc, Gc, and Bc may be generated by the adding of the second compensation value CV2 to the compensated red, compensated green, and compensated blue signals Rc, Gc, and Bc, respectively.

Then, the main color compensation unit 442 generates a backlight compensation signal BLCS based on the second compensation value CV2 and the white difference value Wdiff in step S13. As an example, the backlight compensation signal BLCS may have a value corresponding to a value obtained by subtracting the second compensation value CV2 from the white difference value Wdiff. The backlight compensation signal BLCS increases the luminance of light generated at the backlight unit 300 (in FIG. 1)

to compensate for luminance not sufficiently compensated for by the second compensation value CV2.

Figure 9:
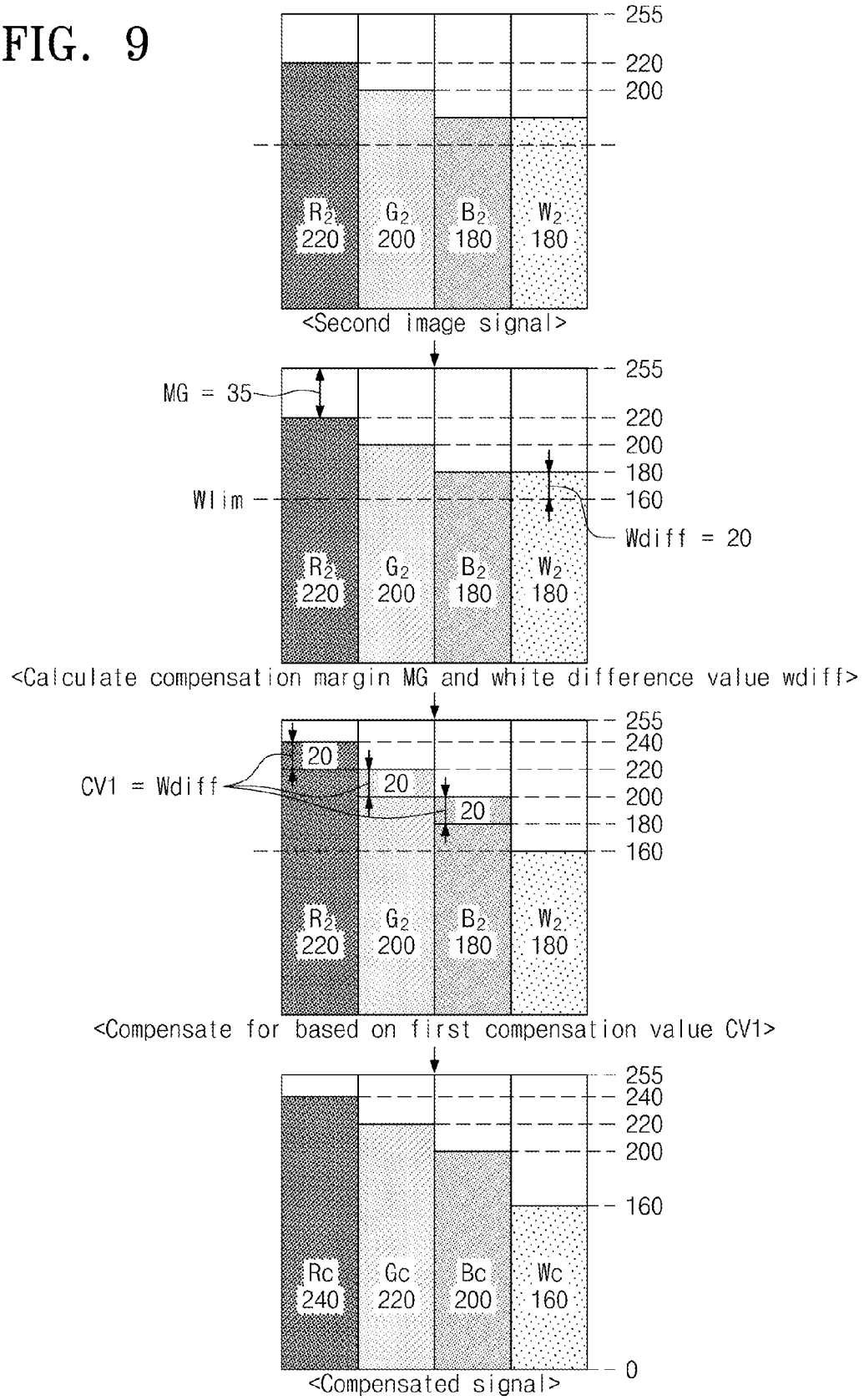
FIG. 9 is a diagram for illustrating an operation according to an embodiment of the inventive concept.

FIG. 9 is a diagram for illustrating an operation according to an embodiment of the inventive concept.

Referring to FIG. 9, as an example, the gray scale values of the second red, second green, second blue and second white signals R2, G2, B2, and W2 may respectively be 220, 200, 180, and 180, the maximum gray scale value may be 255, and the white limit gray scale value Wlim may be 160.

In this case, since the main color compensation unit 442 calculates the white difference value Wdiff having a value of 180−160=20 in step S3 (in FIG. 7) and the gray scale value of the second white signal W2 is larger than the white limit gray scale value Wlim in step S4 (in FIG. 4), the compensated white signal We is generated to be 160 that is the white limit gray scale value Wlim in step S6 (in FIG. 6).

Then, since the main color compensation unit 442 calculates the compensation margin MG having a value of 255−220=35 in step S7 (in FIG. 7) and the compensation margin MG is larger than the white difference value Wdiff in step S8 (in FIG. 7), the first compensation value CV1 having a value of 20 is generated based on the white difference value Wdiff in step S9 (in FIG. 7).

Then, the main color compensation unit 442 adds the first compensation value CV1 to the second red, second green, second blue signals R2, G2, and B2 to generate the compensated red, compensated green, compensated blue, and compensated white signals Rc, Gc, Bc, and We having values of 240, 220, 200, and 160, respectively.

Figure 10:
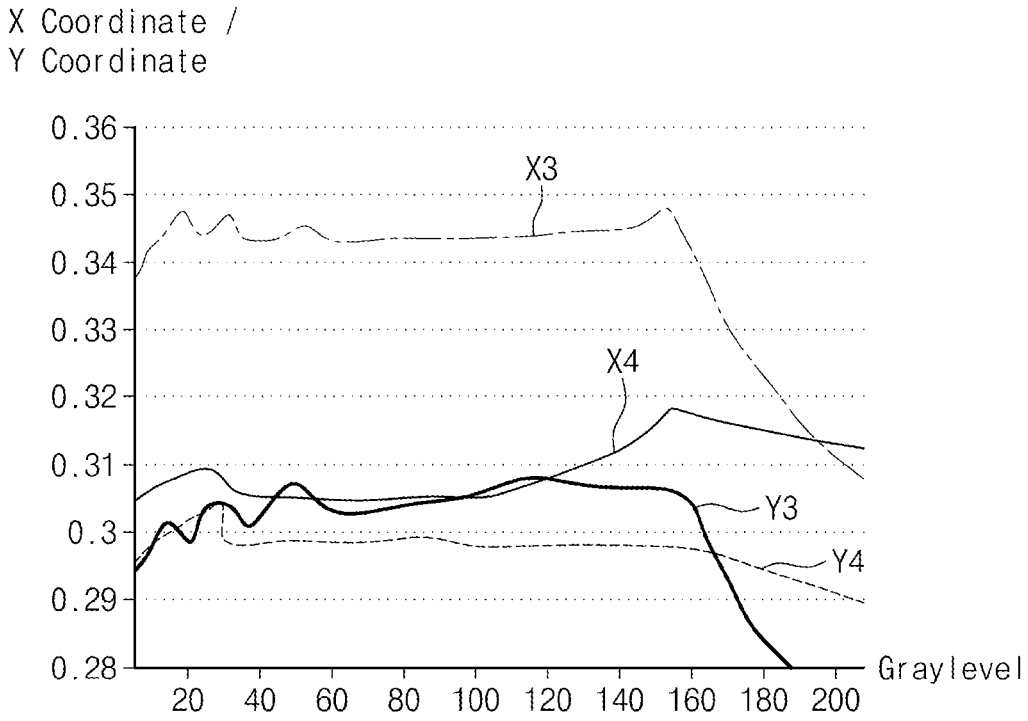
FIG. 10 is a graph of viewing angle vs. color coordinate characteristic of a display device according to an embodiment of the inventive concept.

FIG. 10 is a graph of gray level vs. coordinate characteristic of a display device color according to an embodiment of the inventive concept.

FIG. 10 is a graph showing, a third x coordinate x3 and a third y coordinate y3 on a CIE coordinate system when the display panel 100 displaying a white image through the image data ID compensated for at the hue control compensation unit 440 is viewed from the front and a fourth x coordinate x4 and a fourth y coordinate y4 on the CIE coordinate system when the display panel is viewed from the side, according to the gray scale value of white data of the image data ID.

Referring to FIG. 10, when being viewed from the front, the third x coordinate and third y coordinate (x3, y3) are almost constant at low gray scale and furthermore, when being viewed from the side, the fourth x coordinate and fourth y coordinate (x4, y4) are also almost constant. Thus, it may be seen that transition in hue according to gray scale that may occur on the display device 1000 (in FIG. 1) is inhibited.

Since a human being is generally more sensitive to a difference in y coordinate than that in x coordinate, a variation in hue according to a viewing angle recognized by a user may decrease when there is a small difference in y coordinate between images according to the viewing angle. As shown in FIG. 10, since there is a small difference between third and fourth y coordinates y3 and y4 according to an embodiment of the inventive concept, a variation in hue according to the viewing angle of an image displayed on the display device 1000 according to an embodiment of the inventive concept may decrease and as a result, the display device 1000 may have an improved viewing angle.

In summary, since an image displayed on the white sub pixel Wp (in FIG. 2) has a significant change in color coordinate according to gray scale and a viewing angle, the display device 1000 may reduce the gray scale value of data provide on the white sub pixel Wp to improve picture quality. Since the gray scale values of the data provided on the red, green and blue sub pixels Rp, Gp and Bp are increased, luminance decrease due to reducing the gray scale value of data provide on the white sub pixel Wp may be compensated.

According to embodiments as described above, the gray scale value of the white compensated signal is restricted not to exceed the white limit gray scale value, and the gray scale values of the red, green and blue compensated signals are compensated for based on the white limit gray scale value. Thus, the weight of white displayed on the white sub pixel relatively decreases and the weight of red, green and blue displayed on red, green and blue pixels, respectively relatively increases. As a result, a variation in hue according to a viewing angle of an image displayed on a display device may decrease and the display device may have an improved viewing angle.

While embodiments are described above, a person skilled in the art may understand that many modifications and variations may be implemented without departing from the spirit and scope of the inventive concept defined in the following claims.

What is claimed is:

1. A display device comprising:

a pixel including a red subpixel, a green subpixel, a blue subpixel and a white subpixel;

a gamma mapping unit mapping image information having information on three primary colors to generate image signals comprising red, green, blue, and white image signals;

a compensating signal generation unit including a limit gray scale determination unit to output a white limit gray scale value, the white limit gray scale value being less than a maximum gray scale value of the white subpixel; and a hue control compensation unit comprising a main color compensation unit to generate, red, green, and blue compensated signals based on the red, green, and blue image signals, respectively, and a white compensation unit to generate a white compensated signal based on the white image signal, wherein the white compensation unit decreases a gray scale value of the white image signal for the white subpixel not to exceed the white limit gray scale value and the main color compensation unit increases gray scale values of the red, green and blue image signals for the red, green and blue subpixels, respectively, based on the white limit gray scale value to generate the red, green and blue compensated signals, when the gray scale value of the white image signal is larger than the white limit gray scale value.

2. The display device of claim 1, wherein the hue control compensation unit further comprises a white difference calculation unit to generate a white difference value having a value corresponding to a difference between the gray scale value of the white image signal and the white limit gray scale value, the main color compensation unit calculates a compensation margin, the compensation margin having a value corresponding to a value obtained by subtracting a maximum value of gray scale values of the red, green and blue image signals from a maximum gray scale value of the image signals, and the main color compensation unit compensates the red, green, and blue image signals based on a first compensation value generated by using the white difference value, when the compensation margin is larger than the white difference value.

3. The display device of claim 2, wherein the main color compensation unit compensates for the red, green, and blue image signals based on a second compensation value generated by using the compensation margin, when the compensation margin is smaller than the white difference value.

4. The display device of claim 3, further comprising:

a backlight unit to generate light;

a backlight control unit to drive the backlight unit; and a display panel to display an image corresponding to image data generated based on the image signal, by using the light, wherein the hue control compensation unit further generates a backlight compensation signal based on the white difference value and the compensation margin, and the backlight control unit uses the backlight compensation signal to control the backlight unit.

5. The display device of claim 4, further comprising a scaler analyzing the image signals to calculate scaling values and scaling down the gray scale values of the image signals based on the scaling values to prevent the image signals from being out of gamut, wherein the backlight control unit scales up luminance of light of the backlight unit according to the scaling value.

6. The display device of claim 4, wherein the backlight compensation signal has a value corresponding to a difference between the white difference value and the compensation margin, and the backlight control unit increases luminance of light generated from the backlight unit in response to the backlight compensation signal.

7. The display device of claim 1, further comprising:

a backlight unit to generate light; and a display panel to display an image corresponding to image data generated based on the image signal, by using the light, wherein the white limit gray scale value is predetermined based on a color coordinate characteristic of the display panel according to a viewing angle.

8. The display device of claim 7, wherein change in hue according to the viewing angle of a white image displayed from the display panel is a minimum at the white limit gray scale value.

9. The display device of claim 8, wherein a sum of a difference between first and second x coordinates and a difference between first and second y coordinates has a minimum value at the white limit gray scale value, the first x coordinate and the first y coordinate are x and y coordinates on a CIE coordinate system of a white image displayed on the display panel when viewed from a front, and the second x coordinate and the second y coordinate are x and y coordinates on the CIE coordinate system of the white image displayed on the display panel viewed from a side.

10. The display device of claim 7, wherein the display panel comprises a first substrate, a second substrate, and a liquid crystal layer interposed between the first and second substrates, and the liquid crystal layer comprises a vertically aligned liquid crystal molecule when no electric field is applied to liquid crystal molecules.

11. The display device of claim 10, further comprising a sub pixel rendering unit to receive the red, green, blue and white compensated signals and converting the red green, blue and white compensated signals into red, green, blue, and white image data, respectively, through re-sample filtering, wherein the red, green, blue, and white image data are provided to the red, green, blue, and white sup pixels.

12. The display device of claim 1, further comprising an operation initiate determination unit calculating a hue of the image information and generating an operation initiate signal having information on whether the calculated hue of the image information belongs to a preset target hue, wherein the compensating signal generation unit outputs, in response to the operation initiate signal, the white limit gray scale value when the hue of the image information belongs to the target hue, and the hue control compensation unit compensates for, in response to the operation initiate signal, the red, green, and blue image signals to generate the red, green, blue, and white compensated signals, respectively, when the hue of the image information belongs to the target hue.

13. The display device of claim 1, wherein the compensated white signal has the white limit gray scale value when the gray scale value of the white image signal is larger than the white limit gray scale value.

* * * * *